US007774140B2

(12) United States Patent
Craig

(10) Patent No.: US 7,774,140 B2
(45) **Date of Patent: *Aug. 10, 2010**

(54) METHOD AND AN APPARATUS FOR DETECTING FRACTURE WITH SIGNIFICANT RESIDUAL WIDTH FROM PREVIOUS TREATMENTS

(75) Inventor: David P. Craig, Thornton, CO (US)

(73) Assignee: Halliburton Energy Services, Inc., Duncan, OK (US)

( * ) Notice: Subject to any disclaimer, the term of this patent is extended or adjusted under 35 U.S.C. 154(b) by 1898 days.

This patent is subject to a terminal disclaimer.

(21) Appl. No.: 10/813,698

(22) Filed: Mar. 30, 2004

(65) Prior Publication Data

US 2005/0222852 A1 Oct. 6, 2005

(51) Int. Cl.
*G01V 1/40* (2006.01)

(52) U.S. Cl. ..... 702/11; 702/6; 702/12; 702/13; 73/152.51; 73/152.53; 166/250.1; 166/305.1

(58) Field of Classification Search ..... 702/6, 702/11, 13; 166/250.1; 367/25–35
See application file for complete search history.

(56) References Cited

U.S. PATENT DOCUMENTS 3,285,064 A * 11/1966 Johnson et al. ..... 73/152.37
4,328,705 A * 5/1982 Gringarten ..... 73/152.38
4,531,403 A 7/1985 De Korompay et al. ..... 73/38
4,607,524 A * 8/1986 Gringarten ..... 73/152.02
4,797,821 A * 1/1989 Petak et al. ..... 702/12
5,070,457 A 12/1991 Poulsen ..... 364/420
6,904,366 B2 * 6/2005 Patzek et al. ..... 702/13
7,054,751 B2 * 5/2006 Craig ..... 702/13
7,272,973 B2 * 9/2007 Craig ..... 73/200
7,389,185 B2 * 6/2008 Craig ..... 702/13
2003/0079875 A1 5/2003 Weng ..... 166/250.07

OTHER PUBLICATIONS

Engler et al., Analysis of pressure and pressure derivative without type curve matching, 4. Naturally fractured reservoirs, 1996, Journal of Petroleum Science and Engineering, 15, 127-138.*

Espinosa-Paredes et al., Estimation of static formation temperatures in geothermal wells, 2003, Energy Conversion and Management, 44, p. 1343-1355.*

(Continued)

*Primary Examiner*—Hal D Wachsman
*Assistant Examiner*—Mi'schita' Henson
(74) *Attorney, Agent, or Firm*—Robert A. Kent

(57) ABSTRACT

A refracture-candidate diagnostic test is an injection of compressible or slightly compressible fluid at pressures in excess of minimum in-situ stress and formation fracture pressure with pressure decline following injection test recorded to detect a fracture retaining residual width from previous stimulation treatments. The diagnostic consists of small volume injections with injection time being a small fraction of time required for compressible or slightly compressible reservoir fluid to exhibit pseudoradial flow. The fracture-injection portion of a test can be considered as occurring instantaneously. Data measurements are transformed into a constant rate equivalent pressure transformation to obtain adjusted pressures or adjusted pseudovariables which are analyzed to identify dual unit-slope before and after closure periods confirming a residual retaining width.

26 Claims, 7 Drawing Sheets

OTHER PUBLICATIONS

Foreign Communication From a Related Counterpart (International Application PCT/GB2005/000587, Filed Feb. 17, 2005), Mailing Dated May 30, 2005.

Ayoub, J.A., Bourdet, D.P., and Chauvel, Y.L.: "Impulse Testing," SPEFE p. 534 (Sep. 1988).

Ramey, H.J., Jr., Agarwal, R.G., and Martin, I.: "Analysis of 'Slug Test' or DST Flow Period Data," J. Cdn. Pet. Tech. p. 37 (Jul.-Sep. 1975).

Nolte, K.G.: "Determination of Fracture Parameters From Fracturing Pressure Decline," paper SPE 8341 presented at the 1979 SPE Annual Technical Conference and Exhibition, Dallas, Texas, Sep. 23-25, 1979.

Nolte, K.G.: "A General Analysis of Fracturing Pressure Decline With Application to Three Models," SPEFE p. 571 (Dec. 1986).

Valkó, P. and Economides, M.J.: "Coupling of Elasticity, Flow, and Material Balance," Hydraulic Fracture Mechanics, John Wiley & Sons, New York City Chap. 9, p. 189-233 (1997).

Peres, A.M.M., Onur, M., and Reynolds, A.C.: "A New General Pressure-Analysis Procedure for Slug Tests," SPEFE p. 292 (Dec. 1993).

Rushing, J.A. et al.: "Analysis of Slug Test Data From Hydraulically Fractured Coalbed Methane Wells," paper SPE 21492 presented at the SPE Gas Technology Symposium, Houston, Texas, Jan. 23-25, 1991.

Xiao, J.J. and Reynolds, A.C.: "A Pseudopressure-Pseudotime Transformation for the Analysis of Gas Well Closed Chamber Tests," paper SPE 25879 presented at the 1993 SPE Rocky Mountain Regional/Low-Permeability Reservoirs Symposium, Denver, Colorado, Apr. 12-14, 1993.

Bourdet, D.: Well Test Analysis: The Use of Advanced Interpretation Models, Elsevier, New York City (2002).

Hopkins, C.W., et al.: "Screening Restimulation Candidates in the Antrim Shale," paper SPE 29172 presented at the 1994 SPE Eastern Regional Conference and Exhibition, Charleston, West Virginia, Nov. 8-10, 1994.

Reis, J.C., Fisher, K., and Holcomb, D.: "Measuring Hydraulic Fracture Width Behind Casing Using a Radioactive Proppant," paper SPE 31105 presented at th 1996 SPE Formation Damage Control Symposium, Lafayette, Louisiana, Feb. 14-15, 1996.

* cited by examiner

METHOD AND AN APPARATUS FOR DETECTING FRACTURE WITH SIGNIFICANT RESIDUAL WIDTH FROM PREVIOUS TREATMENTS

FIELD OF THE INVENTION

The present invention pertains generally to the field of oil and gas subsurface earth formation evaluation techniques and more particularly to methods and an apparatus for diagnosing a refracture candidate using a fracture-injection falloff test to rapidly determine if a hydraulic fracture with significant residual width exists in a formation from a previous stimulation treatment(s). More specifically, the invention relates to improved methods and an apparatus of using a plot of transformed pressure and time to determine if a fracture retaining residual width is present. The invention has particular application in using the refracture-candidate diagnostic fracture-injection falloff test to provide a technique for an analyst to determine when and if restimulation is necessary.

BACKGROUND OF THE INVENTION

The oil and gas products that are contained, for example, in sandstone earth formations, occupy pore spaces in the rock. The pore spaces are interconnected and have a certain permeability, which is a measure of the ability of the rock to transmit fluid flow. When some damage has been done to the formation material immediately surrounding the bore hole during the drilling process or if permeability is low, a hydraulic fracturing operation can be performed to increase the production from the well.

Hydraulic fracturing is a process by which a fluid under high pressure is injected into the formation to split the rock and create fractures that penetrate deeply into the formation. These fractures create flow channels to improve the near term productivity of the well. After the parting pressure is released, it has become conventional practice to use propping agents of various kinds, chemical or physical, to hold the crack open and to prevent the healing of the fractures.

The success or failure of a hydraulic fracture treatment often depends on the quality of the candidate well selected for the treatment. Choosing an excellent candidate for stimulation often ensures success, while choosing a poor candidate normally results in economic failure. To select the best candidate for stimulation, there are many parameters to be considered. The most critical parameters for hydraulic fracturing are formation permeability, the in-situ stress distribution, reservoir fluid viscosity, skin factor and reservoir pressure.

During an original completion, oil or gas wells often contain layers bypassed either intentionally or inadvertently. Subsequent restimulation programs designed to identify underperforming wells and recomplete bypassed layers have been unsuccessful partly because the programs tend to oversimplify a complex multilayer problem and focus on commingled well performance and well restimulation potential without thoroughly investigating layer properties and layer recompletion potential. The complexity of a multilayer environment increases as the number of layers with different properties increases. Layers with different pore pressure, fracture pressure, and permeability can coexist in the same group of layers. The biggest detriment for investigating layer properties is a lack of cost-effective diagnostics for determining layer permeability, pressure, and quantifying the effectiveness of previous stimulation treatment(s).

Conventional pressure-transient testing, which includes drawdown, buildup, injection, or pressure-falloff testing, can be used to identify an existing fracture retaining residual width from a previous fracture treatment(s), but conventional testing requires days of production and pressure monitoring for each single layer. Consequently, in a wellbore containing multiple productive layers, weeks to months of isolated-layer testing can be required to evaluate all layers. For many wells, the potential return does not justify this type of investment.

Alternative methods, like an annulus-injection test for diagnosing an open fracture from a previous stimulation treatment(s) are, at best, qualitative and the interpretation is subjective. This method is described in detail in a paper entitled "Screening Restimulation Candidates in the Antrim Shale", SPE 29712 presented by Hopkins, C. W. et al, at the 8-10 Nov. 1994 SPE Eastern Regional Conference and Exhibition, Charleston, W.Va. The annulus-injection test, which was initially developed to identify restimulation candidates in low-permeability gas reservoirs, requires slowly injecting water into a partially depleted formation until the wellbore or wellbore and fracture fill with water. "Fillup" is determined by a rapid increase in pressure, and pressure is always maintained below the fracture pressure of the formation. A well that fills quickly is considered unstimulated, and a well that fills slowly is presumed to have a high-conductivity fracture in communication with the wellbore. Anticipated fillup volumes can be calculated from the proppant volume pumped in a previous stimulation treatment(s), but actual fillup volumes can differ from theoretical fillup volumes substantially; thus the annulus-injection test may not yield accurate data.

Also known in the prior art are various methods that include radioactive logging. One of these methods is also described in a paper "Measuring Hydraulic Fracture Width Behind Casing Using a Radioactive Proppant", SPE 31105 presented by Reis, J. C. et al, at the 14-15 Feb. 1996 SPE Formation Damage Control Symposium, Lafayette, Louisiana. Gamma ray or spectral gamma ray logging devices can be used to identify an open near-wellbore fracture provided previous stimulation treatments were tagged with radioactive isotopes and provided the radioactivity can be measured; however, the depth of investigation of the radioactive logging tools is restricted to within a few inches or feet of the wellbore.

Two other tests that can be used to diagnose a fracture retaining residual width are impulse and slug tests. Impulse tests require an injection or withdrawal of a volume of fluid over a relatively short time period followed by an extended shut-in period, and slug tests require an "instantaneous" imposition of a pressure difference between the wellbore and the reservoir and an extended shut-in period. Typically, the instantaneous pressure difference is created by placing a "slug" of water or a solid cylinder of known volume into the wellbore. The primary difference between the tests is the time of injection or production and both can be used to identify a fracture retaining residual width. However, like the annulus-injection test, the pressure during impulse or slug test is maintained below the fracture pressure of the formation. Similar to conventional pressure-transient testing, an impulse or slug test designed to determine the presence of a fracture retaining residual width from a previous fracture treatment(s) can require relatively long periods of pressure monitoring.

What is needed is an improved technique that can identify objectively and rapidly the presence of a pre-existing open fracture from a previous stimulation treatment(s) and that is economically attractive.

SUMMARY OF THE INVENTION

The present invention pertains generally to the field of oil and gas subsurface earth formation evaluation techniques and more particularly to methods and an apparatus for diagnosing a refracture candidate using a fracture-injection falloff test to rapidly determine if a hydraulic fracture with significant residual width exists in a formation from a previous stimulation treatment(s).

According to the present invention, this test allows a relatively rapid determination of the effectiveness of previous stimulation treatment(s) by injecting a small volume of liquid, gas, or a combination (foam, emulsion, etc.) containing desirable additives for compatibility with the formation at an injection pressure exceeding the formation fracture pressure and recording the pressure falloff. The pressure falloff is analyzed to identify the presence of a fracture retaining residual width from a previous stimulation treatment(s).

The time of injection is minimized such that the time of injection is a small fraction of the time required for the reservoir to exhibit pseudoradial flow; thus, the recorded pressure data from a refracture-candidate diagnostic fracture-injection/falloff test can be transformed using a constant-rate pressure transformation. The transformed data are then analyzed to identify before- and after-closure periods of wellbore storage. The presence of dual unit-slope wellbore storage periods is indicative of a fracture retaining residual width.

In accordance with a first aspect of the present invention, a method of detecting a fracture retaining residual width from a previous well treatment(s) during a well fracturing operation in a subterranean formation containing a reservoir fluid, comprises the steps of:

- injecting a volume of injection fluid into the formation at an injection pressure exceeding the formation fracture pressure;
- gathering pressure measurement data from the formation at various points in time during the injection and a subsequent shut-in period;
- transforming the pressure measurement data into a constant rate equivalent pressure; and
- detecting the presence of a dual unit-slope wellbore storage in the transformed pressure measurement data, said dual unit slope being indicative of the presence of a fracture retaining residual width.

Preferably, the transformation step of said pressure measurement data is based on the properties of the reservoir fluid.

Preferably, the injection time is limited to the time required for the reservoir fluid to exhibit pseudoradial flow.

Also preferably, the reservoir fluid is compressible or slightly compressible.

And preferably, the injection fluid is compressible or slightly compressible and contains desirable additives for compatibility with said formation.

In accordance with a second aspect of the present invention, a system for detecting a fracture retaining residual width from a previous well treatment(s) during a well fracturing operation in a subterranean formation containing a reservoir fluid, comprises:

- a pump for injecting a volume of injection fluid at an injection pressure exceeding the formation fracture pressure;
- means for gathering pressure measurement data in the wellbore at various points in time during the injection and a subsequent shut-in period;
- processing means for transforming the pressure measurement data into a constant rate equivalent pressure; and
- means for detecting the presence of a dual unit-slope wellbore storage in the transformed pressure measurement data, said dual unit slope being indicative of the presence of a fracture retaining residual width.

Preferably, the transformation step of said pressure measurement data is based on the properties of the reservoir fluid.

Preferably, the injection time is limited to the time required for the reservoir fluid to exhibit pseudoradial flow.

Also preferably, the reservoir fluid is compressible or slightly compressible.

And preferably, the injection fluid is compressible or slightly compressible and contains desirable additives for compatibility with said formation.

In accordance with a third aspect of the present invention, a system for detecting a fracture retaining residual width from a previous well treatment(s) during a well fracturing operation in a subterranean formation containing a reservoir fluid, comprises:

- a pump for injecting a volume of injection fluid at an injection pressure exceeding the formation fracture pressure;
- means for gathering pressure measurement data in the wellbore at various points in time during the injection and a subsequent shut-in period;
- processing means for transforming the pressure measurement data into a constant rate equivalent pressure; and
- graphics means for plotting said transformed pressure measurement data representative of before and after closure periods of wellbore storage, and for detecting a dual unit-slope wellbore storage indicative of the presence of a fracture retaining residual width.

Other aspects and features of the invention will become apparent from consideration of the following detailed description taken in conjunction with the accompanying drawings.

BRIEF DESCRIPTION OF THE DRAWINGS

A more complete understanding of the present disclosure and advantages thereof may be acquired by referring to the following description taken in conjunction with the accompanying drawings wherein.

Figure 1:
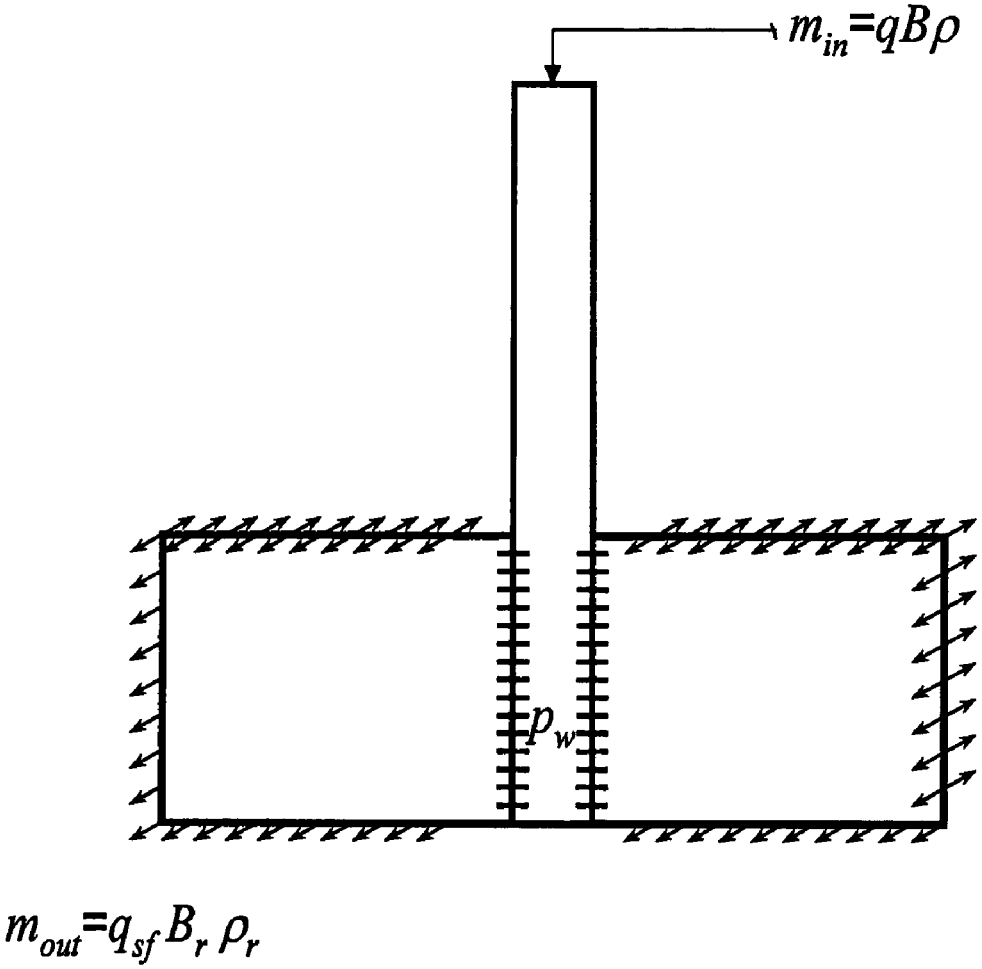
FIG. 1 shows a diagram that establishes the mass balance equation of a wellbore and fracture filled with a single-phase fluid.

The present invention may be susceptible to various modifications and alternative forms. Specific embodiments of the present invention are shown by way of example in the drawings and are described herein in detail. It should be understood, however, that the description set forth herein of specific embodiments is not intended to limit the present invention to the particular forms disclosed. Rather, all modifications, alternatives and equivalents falling within the spirit and scope of the invention as defined by the appended claims are intended to be covered.

DESCRIPTION OF THE PREFERRED EMBODIMENT

A refracture-candidate diagnostic fracture-injection/falloff test is an injection of liquid, gas, or a combination (foam, emulsion, etc.) at pressures in excess of the minimum in-situ stress and formation fracture pressure with the pressure decline following the injection test recorded and analyzed to establish the presence of a fracture retaining residual width from a previous stimulation treatment(s).

Liquid is in general considered as a slightly compressible fluid, whereas gas is a compressible fluid. In the present invention, a slightly compressible fluid is a fluid with a small and constant compressibility. Most reservoir liquids, for example, oil, water, and condensate, can be modeled as slightly compressible. Mathematically, a small and constant compressibility allows the density as a function of pressure to be written as:

$$\rho=\rho_b e^{c(p-p_b)}, \tag{1}$$

wherein $\rho$ is the density of the fluid, $\rho_b$ is the density of the fluid at an arbitrary reference pressure, p is the pressure, $p_b$ is a reference pressure, and c is the compressibility of the fluid.

Diagnostic fracture-injection/falloff tests are small volume injections with the time of the injection a small fraction of the time required for a reservoir fluid to exhibit pseudoradial flow; consequently, the fracture-injection portion of a test can be considered as occurring instantaneously, and a diagnostic fracture-injection/falloff test can be modeled as a slug test where any new hydraulic fracture initiation and propagation or existing hydraulic fracture dilation occur during the "instantaneous" fracture-injection.

A fracture-injection/falloff test results in an open infinite-conductivity hydraulic fracture with pressures above fracture closure stress during the before-closure portion of the pressure falloff and with pressures less than fracture closure stress during the after-closure portion of the pressure falloff.

Four types of models have been experimented with and will be described in more detail as the preferred embodiments according to the present invention. The first model deals with a slightly compressible reservoir fluid and a slightly compressible injected fluid, the second model deals with a slightly compressible reservoir fluid and a compressible injected fluid, the third model deals with a compressible reservoir fluid and a compressible injected fluid and finally the fourth model deals with a compressible reservoir fluid and a slightly compressible injected fluid. For each model, the hypothesis regarding the parameters and variables will differ whether it is before-fracture closure or after-fracture closure.

I) Slightly-Compressible Reservoir Fluid and Injected Fluid

FIG. 1 illustrates a diagram that establishes a mass balance equation which is based on the assumption that a slightly-compressible single-phase fluid fills the wellbore and that there is an open hydraulic fracture. The equation of the mass balance can then be written as:

$$\frac{m_{in}}{qB\rho}-\frac{m_{out}}{q_{sf}B_r\rho_r}=\overbrace{V_{wb}\frac{d\rho_{wb}}{dt}+2\frac{d(V_f\rho_f)}{dt}}^{Storage}, \text{ or} \tag{2}$$

$$qB\rho-q_{sf}B_r\rho_r=V_{wb}\frac{d\rho_{wb}}{dt}+2V_f\frac{d\rho_f}{dt}+2\rho_f\frac{dV_f}{dt}, \tag{3}$$

where q is the surface injection rate,

B is the formation volume factor of the injected fluid, $\rho$ is the density of the injected fluid, $q_{sf}$ is the sandface injection rate, $B_r$ is the formation volume factor of the reservoir fluid, $\rho_r$ is the density of the reservoir fluid, $V_{wb}$ is the wellbore volume, $\rho_{wb}$ is the wellbore fluid density, $V_f$ is the volume of one wing of a fracture symmetrical about the wellbore, $\rho_f$ is the density of the fluid filling the fracture, and t is the time.

For the wellbore, $$\frac{d\rho_{wb}}{dt}=\rho_{wb}\frac{1}{\rho_{wb}}\frac{d\rho_{wb}}{dp_w}\frac{dp_w}{dt}=\rho_{wb}c_{wb}\frac{dp_w}{dt}, \tag{4}$$

where $c_{wb}$ is the isothermal compressibility of the wellbore fluid.

The volume of an open fixed-length fracture can be written as:

$$V_f=A_f\bar{w}, \tag{5}$$

where $A_f$ is the area of one face of one fracture wing, and $\bar{w}$ is the average fracture width.

In a paper SPE 8341 entitled "Determination of Fracture Parameters from Fracturing Pressure Decline", presented at the 1979 SPE Annual Technical Conference and Exhibition, Dallas, Texas, 23-25 Sep. 1979, Nolte demonstrated that the average width, $\bar{w}$, can be written in terms of net pressure, or pressure in excess of fracture closure stress, as:

$$\bar{w}=\frac{p_n}{S_f}=\frac{p_w(t)-p_c}{S_f}, \tag{6}$$

where $p_n$ is the net pressure, $p_w(t)$ is the pressure as a function of time, $p_c$ is the fracture closure pressure, and $S_f$ is the fracture "stiffness."

Fracture stiffness, or the inverse of fracture compliance, is defined by the elastic energy or "strain energy" created by an open fracture in a rock assuming linear elastic theory is applicable. Table 1 contains the fracture stiffness definitions for three common 2D fracture models as defined by Valko, P and Economides, M. J. in "Coupling of Elasticity, Flow, and Material Balance", Hydraulic Fracture Mechanics, John Wiley & Sons, New York City (1997) Chap 9, 189-233. In Table 1, E' is the plane-strain modulus, $R_f$ is the fracture radius of a radial fracture, $h_f$ is the gross fracture height, and $L_f$ is the fracture half-length.

TABLE 1

Fracture stiffness for 2D fracture models

| Radial | Perkins-Kern-Nordgren | Geertsma-deKlerk |
|---|---|---|
| $(S_f)_{RAD} \equiv \frac{3\pi E'}{16R_f}$ | $(S_f)_{PKN} \equiv \frac{2E'}{\pi h_f}$ | $(S_f)_{GDK} \equiv \frac{E'}{(\pi L)_f}$ |

Assuming a single vertical fracture grows in the direction of maximum stress, then the volume of one wing of the fracture at pressures below the minimum in-situ or "closure" stress can be written as:

$$V_f = A_f \overline{w}_{f0},\ p_w(t) < p_c, \tag{7}$$

where $\overline{w}_{f0}$ is the average retained residual fracture width.

At a pressure above the minimum in-situ stress, but below the closure stress on the propping agents acting to hold the fracture open, $p_{c,prop}$, the volume of one wing of the fracture can be written as:

$$V_f = A_f \overline{w}_{f0}\left[1 + \frac{\Delta \overline{w}_f(p)}{\overline{w}_{f0}}\right],\ p_c \le p_w(t) \le p_{c,prop}, \tag{8}$$

where $\Delta\overline{w}_f$ is the change in residual width as a function of pressure.

For example, the change in residual width of a fracture containing sand propping agent is a function proppant bulk density, $\rho_{b,prop}(p)$, and proppant embedment, $\epsilon_{prop}(p)$. Other factors including proppant crushing, proppant solubility, and stress cycling can also effect the change in residual width.

At pressures above the closure stress on the proppant, $p_{c,prop}$, the volume of one wing of the fracture can be written as:

$$V_f = A_f \frac{p_n(t)}{S_f},\ p_w(t) > p_{c,prop}, \tag{9}$$

which can be used to define the change in fracture volume with respect to time and is written as:

$$\frac{dV_f}{dt} = \frac{A_f}{S_f}\frac{dp_n(t)}{dt},\ p_n > 0. \tag{10}$$

Assume a constant density, $\rho=\rho_{wb}=\rho_f=\rho_r$, and a constant formation volume factor, $B=B_r$, then the mass balance can be written as:

$$q = \begin{cases} q_{sf} + \frac{[c_{wb}V_{wb} + 2c_f A_f \overline{w}_{f0}]}{B}\frac{dp_w(t)}{dt}, & p_w(t) < p_c \\ q_{sf} + c_{wb}V_{wb}\frac{1}{B}\frac{dp_w}{dt} + \frac{2c_f A_f \overline{w}_{f0}}{B} & p_c \le p_w(t) \le p_{c,prop} \\ \left[1 + \frac{\Delta_{wf}(p)}{\overline{w}_{f0}}\right]\frac{dp_w(t)}{dt} + \\ 2A_f \frac{d\Delta w_f(p)}{dp_w}\frac{dp_w(t)}{dt}, \\ q_{sf} + c_{wb}V_{wb}\frac{1}{B}\frac{dp_w}{dt} + \frac{2A_f}{BS_f} & p_{c,prop} < p_w(t) \\ [c_f p_n(t) + 1]\frac{dp_w(t)}{dt}. \end{cases} \tag{11}$$

Eq. 11 relates the surface flow rate to the sandface flow rate in a reservoir containing a hydraulic fracture at pressures above the fracture closure stress, and, more importantly, Eq. 11 shows that a wellbore storage coefficient extracted from Eq. 11 will not be constant. A constant wellbore storage coefficient, however, can be written for a before-fracture closure limiting case and after-fracture closure limiting case.

1) Before Fracture Closure

Before fracture closure, when $p_{c,prop}<p_w(t)$, $$2\rho_f \frac{dV_f}{dt} \gg V_{wb}\frac{d\rho_{wb}}{dt} + 2V_f\frac{d\rho_f}{dt}, \tag{12}$$

such that Eq. 11 can be written as:

$$q = q_{sf} + \left[\frac{2A_f}{S_f}\right]\frac{1}{B}\frac{dp_w}{dt},\ p_{c,prop} < p_w(t). \tag{13}$$

Define $$C_{bc} \equiv \frac{2A_f}{S_f}, \tag{14}$$

where $C_{bc}$ is the before-closure wellbore-storage coefficient, which is typically constant provided fracture area and stiffness are constant during closure.

Then Eq. 14 can be written as:

$$\frac{q}{q_{sf}} = 1 + \frac{C_{bc}}{q_{sf}B}\frac{dp_w}{dt},\ p_{c,prop} < p_w(t), \tag{15}$$

where q is the surface injection rate, $q_{sf}$ is the sandface injection rate,

B is the formation volume factor of the injected fluid, and $C_{bc}$ is the before-closure wellbore-storage coefficient.

2) After Fracture Closure

After fracture closure, when $p_w(t)<p_c$, and when a fracture retains significant residual width $\overline{w}_{f0}>0$, Eq. 3 can be written as:

$$qB\rho = q_{sf}B\rho + V_{wb}\frac{d\rho}{dt} + 2V_f\frac{d\rho}{dt},\ p_w(t) < p_c\ \&\ \overline{w}_{f0} > 0, \tag{16}$$

which, assuming a constant density, $\rho=\rho_{wb}=\rho_f=\rho_r$, and a constant formation volume factor, $B=B_r$, can also be written as:

$$\begin{aligned} q &= q_{sf} + (c_{wb}V_{wb} + 2c_fV_{f0})\frac{1}{B}\frac{dp_w}{dt}, \\ &= q_{sf} + (c_{wb}V_{wb} + 2c_fA_f\overline{w}_{f0})\frac{1}{B}\frac{dp_w}{dt}, \\ p_w(t) &< p_c\ \&\ \overline{w}_{f0} > 0, \end{aligned} \tag{17}$$

where $c_f$ is the compressibility of the fluid in the fracture, $\overline{w}_{f0}$ is the average retained residual fracture width, and $V_{f0}$ is the retained residual fracture volume.

Define $$C_{ac} \cong c_{wb}V_{wb} + 2C_fA_f\overline{w}_f, \tag{18}$$

where $C_{ac}$ is the after-closure wellbore-storage coefficient, which for the limiting case is typically constant.

Then Eq. 17 can be written as:

$$\frac{q}{q_{sf}} = 1 + \frac{C_{ac}}{q_{sf}B}\frac{dp_w}{dt},\ p_w(t) < p_c\ \&\ \overline{w}_{f0} > 0, \tag{19}$$

where q is the surface injection rate, $q_{sf}$ is the sandface injection rate,

B is the formation volume factor of the injected fluid, and $C_{ac}$ is the after-closure wellbore-storage coefficient.

Figure 4:
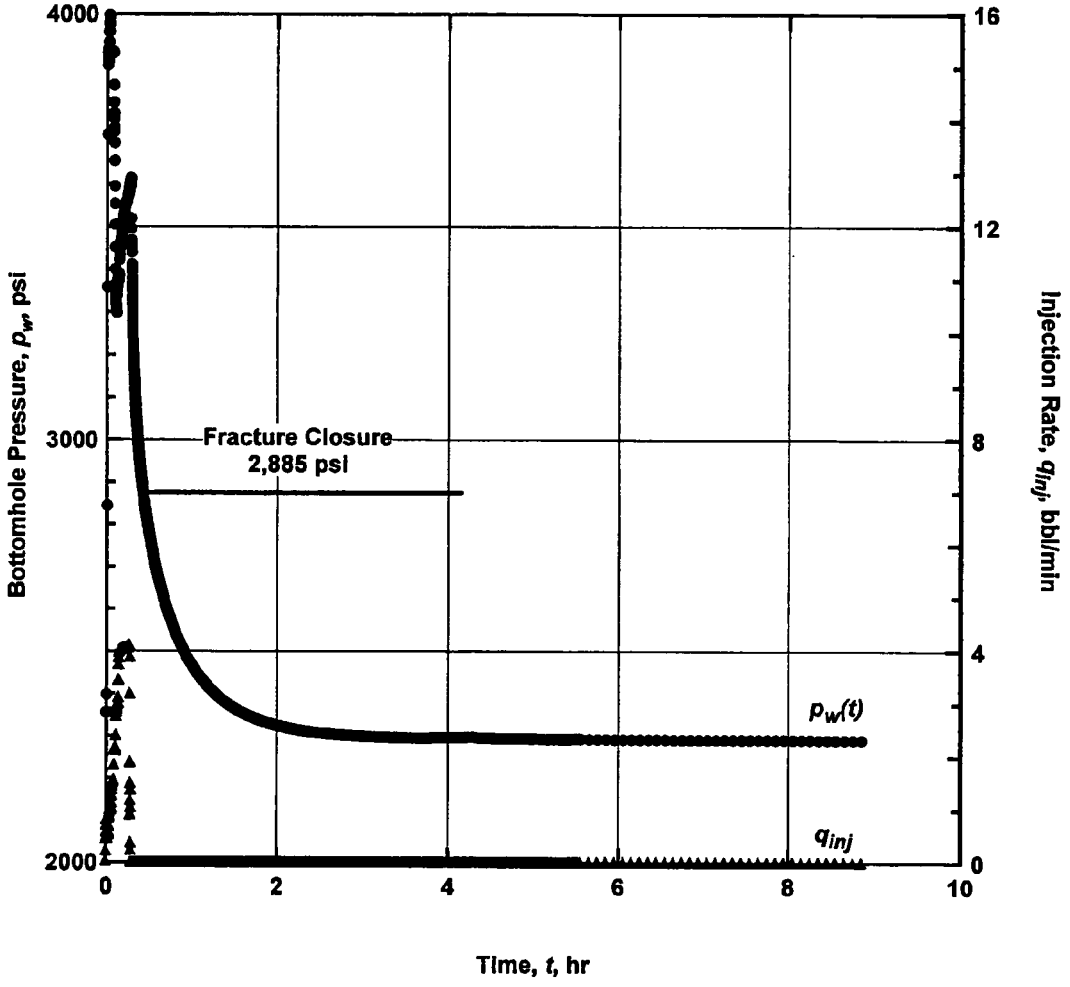
FIG. 4 is a graph of bottomhole pressure and injection rate versus time for the fracture injection/falloff test in a reservoir without a pre-existing hydraulic fracture.
Figure 5:
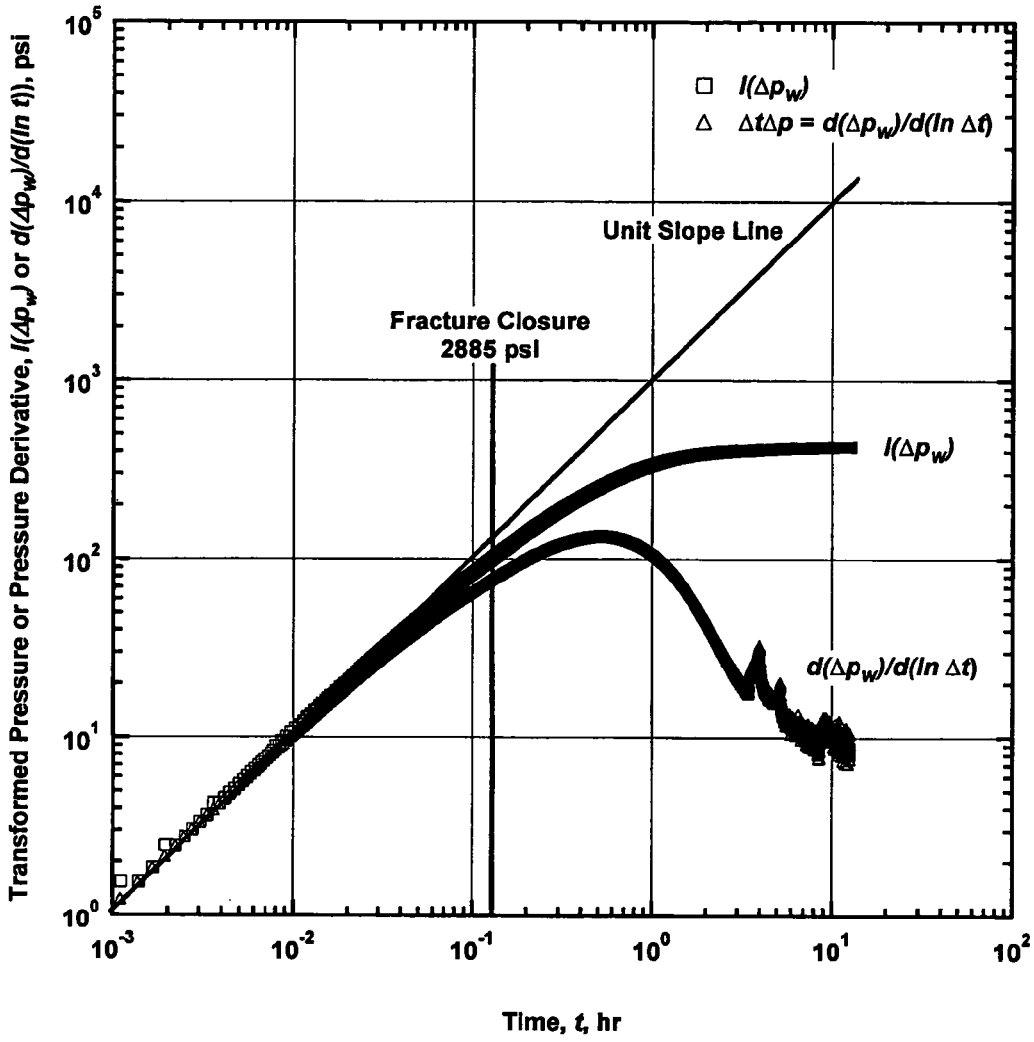
FIG. 5 is a second log-log graph of the transformed fracture injection/falloff test shut-in pressure data showing only a single unit slope wellbore storage during closure and indicating no retained residual fracture width.

FIG. 4 shows a case combining slightly compressible reservoir fluid and slightly compressible injected fluid illustrated by a graph of surface pressure and injection rate versus time for the fracture-injection/falloff test in an environment of water saturated coal reservoir. FIG. 5 depicts log-log plotting of the transformed shut-in pressure data. The experimental conditions of these graphs are detailed later on.

II) Slightly-Compressible Reservoir Fluid and Compressible Injected Fluid

In this second model, we assume that a compressible single-phase fluid fills the wellbore and an open hydraulic fracture, but the reservoir is saturated with a slightly-compressible fluid. Then the mass balance equation can be written as:

$$q_gB_g\rho_g - (q_g)_{sf}(B_g)_{sf}(\rho_g)_{sf} = V_{wb}\frac{d(\rho_g)_{wb}}{dt} + 2V_f\frac{d(\rho_g)_f}{dt} + 2(\rho_g)_f\frac{dV_f}{dt}, \tag{20}$$

where $q_g$ is the surface compressible fluid injection rate, $B_g$ is the formation volume factor of the injected compressible fluid, $\rho_g$ is the density of the compressible injected fluid, $(q_g)_{sf}$ is the sandface compressible fluid injection rate, $(B_g)_{sf}$ is the formation volume factor of the injected compressible fluid at the sandface, $(\rho_g)_{sf}$ is the density of the injected compressible fluid at the sandface, $(\rho_g)_{wb}$ is the density of the wellbore compressible fluid, and $(\rho_g)_f$ is the density of the compressible fluid filling the fracture.

Assuming the compressible fluid density is described by the real-gas law then the derivative of compressible fluid density with respect to time can be written as:

$$\frac{d\rho_g}{dt} = \rho_g c_g\frac{dp}{dt}, \tag{21}$$

and Eq. 20 is written as:

$$q_gB_g\rho_g - (q_g)_{sf}(B_g)_{sf}(\rho_g)_{sf} = (\rho_g)_{wb}(c_g)_{wb}V_{wb}\frac{dp_w}{dt} + 2(\rho_g)_f(c_g)_fV_f\frac{dp_w}{dt} + 2(\rho_g)_f\frac{dV_f}{dt}. \tag{22}$$

Assume that $(\rho_g)_{sf}=(\rho_g)_{wb}=(\rho_g)_f$, and $B_g \cong (B_g)_{sf} \cong \overline{B}_g$, then Eq. 22 can be written as:

$$\frac{q_g\rho_g}{(q_g)_{sf}(\rho_g)_{sf}} = 1 + \frac{(c_g)_{wb}V_{wb} + 2(c_g)_fV_f}{(q_g)_{sf}\overline{B}_g}\frac{dp_w}{dt} + \frac{2A_f}{S_f}\frac{1}{(q_g)_{sf}\overline{B}_g}\frac{dp_n(t)}{dt}. \tag{23}$$

1) Before Fracture Closure

Before fracture closure, when $p_{c,prop}<p_w(t)$, $$2(\rho_g)_f\frac{dV_f}{dt} \gg V_{wb}\frac{d(\rho_g)_{wb}}{dt} + 2V_f\frac{d(\rho_g)_f}{dt}, \tag{24}$$

and Eq. 23 reduces to:

$$\frac{q_g\rho_g}{(q_g)_{sf}(\rho_g)_{sf}} = 1 + \left[\frac{2A_f}{S_f}\right]\frac{1}{(q_g)_{sf}\overline{B}_g}\frac{dp_w}{dt},\ p_{c,prop} < p_w(t),\ \text{or} \tag{25}$$

$$\frac{q_g\rho_g}{(q_g)_{sf}(\rho_g)_{sf}} = 1 + \frac{C_{bc}}{(q_g)_{sf}\overline{B}_g}\frac{dp_w}{dt},\ p_{c,prop} < p_w(t), \tag{26}$$

where $q_g$ is the surface compressible fluid injection rate, $(q_g)_{sf}$ is the sandface compressible fluid injection rate, $B_g \cong (B_g)_{sf} \cong \overline{B}_g$, is the formation volume factor of the injected compressible fluid, $\rho_g$ is the density of the compressible injected fluid, $(\rho_g)_{sf}$ is the density of the injected compressible fluid at the sandface, and $C_{bc}$ is the before-closure wellbore-storage coefficient.

2) After Fracture Closure

After fracture closure, when $p_w(t)<p_c$, and when a fracture retains significant residual width, $\overline{w}_{f0}>0$, Eq. 22 can be written as:

$$q_g B_g \rho_g = (q_g)_{sf}(B_g)_{sf}(\rho_g)_{sf} + V_{wb}\frac{d(\rho_g)_{wb}}{dt} + 2V_f\frac{d(\rho_g)_{wb}}{dt}, \quad (27)$$

$$p_w(t) < p_c \ \& \ \overline{w}_{f0} > 0,$$

and Eq. 27 reduces to:

$$\frac{q_g\rho_g}{(q_g)_{sf}(\rho_g)_{sf}} = 1 + \frac{(c_g)_{wb}V_{wb} + 2(c_g)_f V_f}{\overline{B}_g}\frac{dp_w}{dt} = 1 + \left[(c_g)_{wb}V_{wb} + 2(c_g)_f A_f \overline{w}_{f0}\right]\frac{1}{(q_g)_{sf}\overline{B}_g}\frac{dp_w}{dt}, \quad (28)$$

$$p_w(t) < p_c \ \& \ \overline{w}_{f0} > 0.$$

Let $\overline{c}_g \equiv (c_{g0}+c_{gi})/2$, then Eq. 28 can be written as:

$$\frac{q_g\rho_g}{(q_g)_{sf}(\rho_g)_{sf}} = 1 + \left[(\overline{c}_g)_{wb}V_{wb} + 2(\overline{c}_g)_f A_f \overline{w}_{f0}\right]\frac{1}{(q_g)_{sf}\overline{B}_g}\frac{dp_w}{dt}, \quad (29)$$

$$p_w(t) < p_c \ \& \ \overline{w}_{f0} > 0,$$

Define $$C_{acc} \equiv (\overline{c}_g)_{wb}V_{wb} + 2(\overline{c}_g)_f A_f \overline{w}_{f0}, \text{ and} \quad (30)$$

$$\frac{q_g\rho_g}{(q_g)_{sf}(\rho_g)_{sf}} = 1 + \frac{C_{acc}}{(q_g)_{sf}\overline{B}_g}\frac{dp_w}{dt}, \ p_w(t) < p_c \ \& \ \overline{w}_{f0} > 0, \quad (31)$$

where $q_g$ is the surface compressible fluid injection rate, $(q_g)_{sf}$ is the sandface compressible fluid injection rate, $B_g \cong (B_g)_{sf} \cong \overline{B}_g$, is the formation volume factor of the injected compressible fluid, $\rho_g$ is the density of the compressible injected fluid, $(\rho_g)_{sf}$ is the density of the injected compressible fluid at the sandface, and $C_{acc}$ is the after-closure wellbore-storage coefficient with compressible injected fluid.

III) Compressible Reservoir Fluid and Compressible Injected Fluid

For refracture-candidate diagnostic fracture-injection/falloff test conducted by injecting a gas or compressible fluid in a reservoir containing a compressible fluid, a similar result can be derived. For a compressible fluid, pseudovariables, or for convenience, adjusted pseudovariables are used to transform the pressure and time data prior to the constant-rate data transformation as shown by Xiao, J. J. and Reynolds, A. C. in "A Pseudopressure-Pseudotime Transformation for the Analysis of Gas Well Closed Chamber Tests" paper SPE 25879 presented at the 1993 SPE Rocky Mountain Regional/Low-Permeability Reservoirs Symposium, Denver, Colorado, 12-14 Apr. 1993.

1) Before-Fracture Closure

Before fracture closure, when $p_{c,prop} < p_w(t)$, $$2(\rho_g)_f\frac{dV_f}{dt} \gg V_{wb}\frac{d(\rho_g)_{wb}}{dt} + 2V_f\frac{d(\rho_g)_f}{dt}, \quad (32)$$

and Eq. 22 reduces to $$\frac{q_g\rho_g}{(q_g)_{sf}(\rho_g)_{sf}} = 1 + \left[\frac{2A_f}{S_f}\right]\frac{1}{(q_g)_{sf}\overline{B}_g}\frac{dp_w}{dt}, \ p_{c,prop} < p_w(t), \text{ or} \quad (33)$$

$$\frac{q_g\rho_g}{(q_g)_{sf}(\rho_g)_{sf}} = 1 + \frac{C_{bc}}{(q_g)_{sf}\overline{B}_g}\frac{dp_w}{dt}, \ p_{c,prop} < p_w(t), \quad (34)$$

where $q_g$ is the surface compressible fluid injection rate, $(q_g)_{sf}$ is the sandface compressible fluid injection rate, $B_g \cong (B_g)_{sf} \cong \overline{B}_g$, is the formation volume factor of the injected compressible fluid, $\rho_g$ is the density of the compressible injected fluid, $(\rho_g)_{sf}$ is the density of the injected compressible fluid at the sandface, and $C_{bc}$ is the before-closure wellbore-storage coefficient.

2) After-Fracture Closure

After fracture closure, $p_w(t) < p_c$, if a fracture retains residual width, $\overline{w}_{f0} > 0$, Eq. 22 can be written as:

$$\frac{q_g\rho_g}{(q_g)_{sf}(\rho_g)_{sf}} = 1 + \frac{(c_g)_{wb}V_{wb} + 2(c_g)_f V_f}{(q_g)_{sf}\overline{B}_g}\frac{dp_w}{dt}, \quad (35)$$

$$p_w(t) < p_c \ \& \ \overline{w}_{f0} > 0.$$

or using Eq. 29 written as:

$$\frac{q_g\rho_g}{(q_g)_{sf}(\rho_g)_{sf}} = 1 + \left[\frac{C_{acc}}{(q_g)_{sf}\overline{B}_g}\right]\frac{dp_w}{dt}, \ p_w(t) < p_c \ \& \ \overline{w}_{f0} > 0, \quad (36)$$

where $q_g$ is the surface compressible fluid injection rate, $(q_g)_{sf}$ is the sandface compressible fluid injection rate, $B_g \cong (B_g)_{sf} \cong \overline{B}_g$, is the formation volume factor of the injected compressible fluid, $\rho_g$ is the density of the compressible injected fluid, $(\rho_g)_{sf}$ is the density of the injected compressible fluid at the sandface, and $C_{acc}$ is the after-closure wellbore-storage coefficient with compressible injected fluid.

IV) Compressible Reservoir Fluid and Slightly-Compressible Injected Fluid

A similar derivation can be used for refracture-candidate diagnostic fracture-injection/falloff tests consisting of a slightly compressible fluid injection in a reservoir containing a compressible fluid.

1) Before-Fracture Closure

Before fracture closure, when $p_{c,prop}<P_w(t)$, $$2(\rho_g)_f \frac{dV_f}{dt} \gg V_{wb}\frac{d(\rho_g)_{wb}}{dt} + 2V_f\frac{d(\rho_g)_f}{dt}, \quad (37)$$

and combining Eqs. 13 and 14 results in $$\frac{q}{q_{sf}} = 1 + \frac{C_{bc}}{q_{sf}B}\frac{dp_w}{dt},\ p_{c,prop} < p_w(t), \quad (38)$$

where q is the surface injection rate, $q_{sf}$ is the sandface injection rate,

B is the formation volume factor of the injected fluid, and $C_{bc}$ is the before-closure wellbore-storage coefficient.

2) After-Fracture Closure

After fracture closure, $p_w(t)<p_c$, if a fracture retains residual width, $\overline{w}_{f0}>0$, the material balance equation is the same as Eq. 17 and written as:

$$\frac{q}{q_{sf}} = 1 + \frac{c_{wb}V_{wb} + 2c_fV_f}{q_{sf}B}\frac{dp_w}{dt},\ p_w(t) < p_c\ \&\ \overline{w}_{f0} > 0, \quad (39)$$

or using Eq. 19 written as:

$$\frac{q}{q_{sf}} = 1 + \frac{C_{ac}}{q_{sf}B}\frac{dp_w}{dt},\ p_w(t) < p_c\ \&\ \overline{w}_{f0} > 0, \quad (40)$$

where q is the surface injection rate, $q_{sf}$ is the sandface injection rate,

B is the formation volume factor of the injected fluid, $C_{ac}$ is the after-closure wellbore-storage coefficient, and $\overline{w}_{f0}>0$, is the existence of a residual fracture width.

Figure 2:
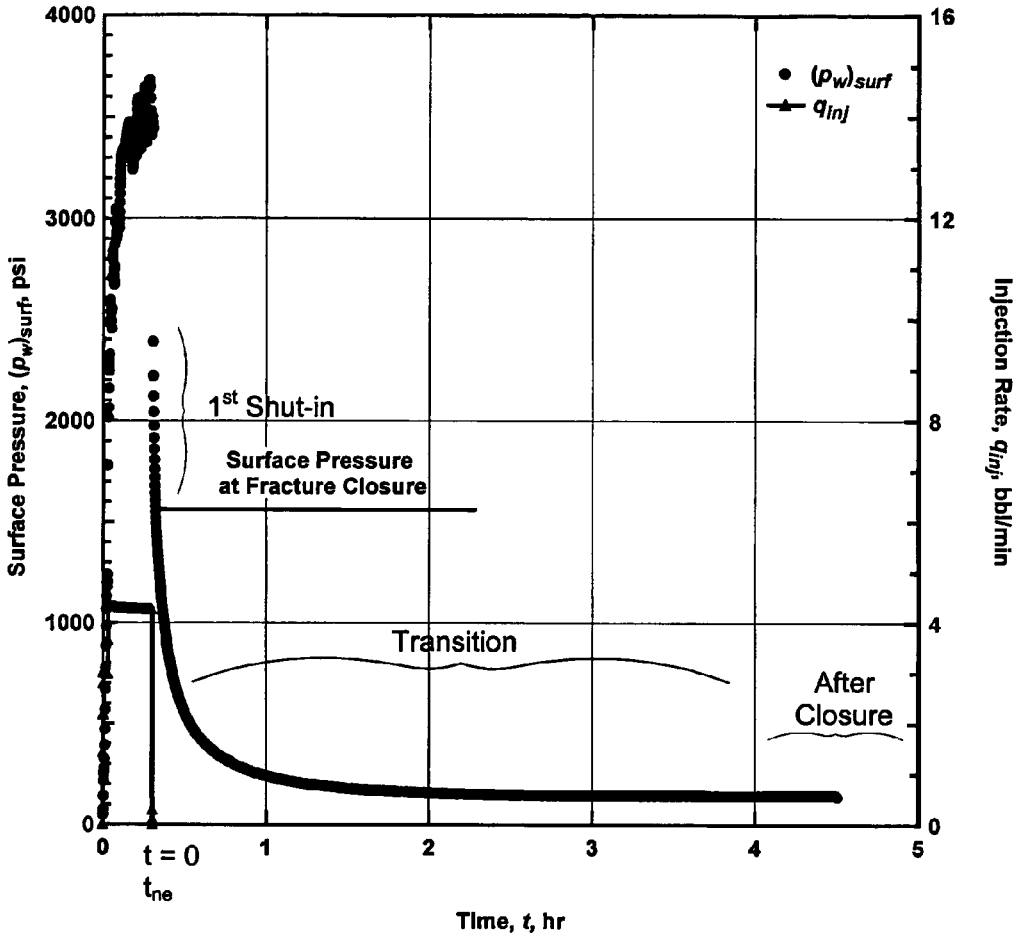
FIG. 2 is a first graph of the surface pressure and injection rate versus time for the fracture injection/falloff test in a reservoir containing a pre-existing hydraulic fracture with retained residual width.
Figure 3:
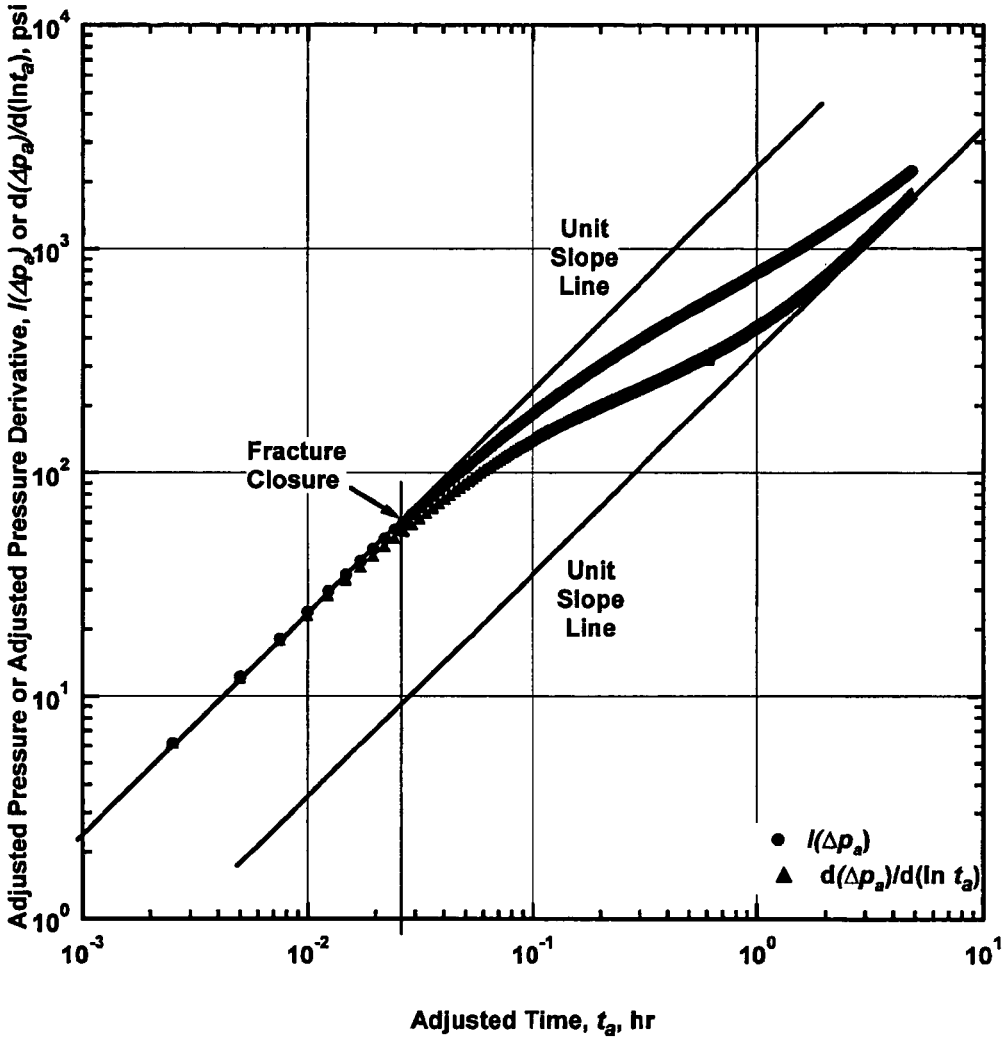
FIG. 3 is a first log-log graph of the transformed fracture injection/falloff test shut-in pressure data, such as adjusted pressure and adjusted pressure derivative, showing a dual unit slope wellbore storage and indicating a fracture retaining residual width.

FIG. 2 shows a case combining compressible reservoir fluid and slightly compressible injected fluid illustrated by a graph of surface pressure and injection rate versus time for the fracture-injection/falloff test in an environment of low permeability tight-gas sandstone. FIG. 3 depicts both log-log plotting of transformed shut-in data in terms of adjusted pseudovariables using a constant-rate data transformation. The experimental conditions of these graphs are detailed later on.

Table 2 summarizes the before-closure and after-closure limiting case wellbore storage coefficients for the four combinations of compressible or slightly-compressible injection and reservoir fluids.

TABLE 2

Before closure and after closure limiting case wellbore storage coefficients.

| Injected/Resevoir Fluid | Before-Closure Wellbore Storage Coefficient | After-Closure Wellbore Storage Coefficient |
|---|---|---|
| Slightly Compressible/ Slightly Compressible | $C_{bc} = \frac{2A_f}{S_f}$ | $C_{ac} = c_{wb}V_{wb} + 2c_fA_f\overline{w}_{f0}$ |
| Compressible/ Slightly Compressible | $C_{bc} = \frac{2A_f}{S_f}$ | $C_{acc} = (\overline{c}_g)_{wb}V_{wb} + 2(\overline{c}_g)_fA_f\overline{w}_{f0}$ |
| Slightly Compressible/ Compressible | $C_{bc} = \frac{2A_f}{S_f}$ | $C_{ac} = c_{wb}V_{wb} + 2c_fA_f\overline{w}_{f0}$ |
| Compressible/ Compressible | $C_{bc} = \frac{2A_f}{S_f}$ | $C_{acc} = (c_g)_{wb}V_{wb} + 2(\overline{c}_g)_fA_f\overline{w}_{f0}$ |

Once the simplified mass balance equations have been obtained for the four combinations using the appropriated assumptions, these equations can be used to introduce dimensionless variables of times and pressures.

V) Material Balance Equations in Terms of Dimensionless Variables

During the shut-in period following a fracture-injection/falloff test, the surface rate is zero (q=0), thus the material balance equations for the limiting cases for slightly compressible injection fluids can be written as:

$$1 = -\frac{C}{q_{sf}B}\frac{dp_w}{dt}, \quad (41)$$

or written as:

$$1 = -\frac{C}{(q_g)_{sf}\overline{B}_g}\frac{dp_w}{dt}, \quad (42)$$

for compressible injection fluids where C represents either $C_{bc}$, $C_{ac}$, or $C_{acc}$.

1) When the reservoir fluid is slightly compressible, dimensionless pressure is defined as:

$$p_{wD} = \frac{2\pi kh(p_i - p_w)}{q_{sf} B\mu}, \tag{43}$$

where k is the permeability, h is the formation permeable thickness,

μ is the viscosity, and $p_i$ is the initial pressure, then $$dp_w = \frac{-q_{sf} B\mu}{2\pi kh} dp_{wD}. \tag{44}$$

With a slightly compressible reservoir fluid, dimensionless time is defined as:

$$t_{L_f D} = \frac{kt}{\phi\mu c_t L_f^2}, \tag{45}$$

where

ϕ is the porosity, $L_f$ is created hydraulic fracture half-length, and $c_t$ is the total compressibility, then $$dt = \frac{\phi\mu c_t L_f^2}{k} dt_{L_f D}. \tag{46}$$

In order to have the reservoir exhibit pseudoradial flow, experimental values of the dimensionless time are very often above 3.

With Eqs. 44 and 46, the material balance equation for a slightly compressible injection fluid and a slightly compressible reservoir fluid can be written as:

$$1 = \frac{C}{2\pi\phi c_t h L_f^2} \frac{dp_{wD}}{dt_{L_f D}}. \tag{47}$$

The dimensionless wellbore storage coefficient, $C_{L_f D}$, can now be defined as:

$$C_{L_f D} \equiv \frac{C}{2\pi\phi c_t h L_f^2}, \tag{48}$$

and the material balance can be written as:

$$1 = C_{L_f D} \frac{dp_{wD}}{dt_{L_f D}}. \tag{49}$$

With a slightly compressible reservoir fluid and a compressible injection fluid, the material balance equation is derived from Eq. 42. Recognizing that during the before-closure pressure decline, the compressible fluid penetrates only a very short distance into the reservoir from the fracture face, the properties of the slightly compressible reservoir fluid dominate the diffusion process, that is, the reservoir properties and reservoir fluid control the diffusion rate, $dp_w/dt$. Consequently, assume piston-like displacement, which results in:

$$(q_g)_{sf} \bar{B}_g = qB, \tag{50}$$

and the material balance equation, Eq. 42, for a compressible injection fluid and a slightly compressible reservoir fluid can be written as:

$$-1 = \frac{C}{(q_g)_{sf} \bar{B}_g} \frac{dp_w}{dt} = \frac{C}{q_{sf} B} \frac{dp_w}{dt}. \tag{51}$$

Thus, regardless of injected fluid, when the reservoir fluid is slightly compressible, the dimensionless wellbore storage coefficient is defined by Eq. 48, and the material balance equation is defined by Eq. 49.

2) For compressible reservoir fluids, pseudovariables, or for convenience, adjusted pseudovariables, are used to transform the pressure and time data as shown by Xiao, J. J. and Reynolds, A. C. in "A Pseudopressure-Pseudotime Transformation for the Analysis of Gas Well Closed Chamber Tests" paper SPE 25879 presented at the 1993 SPE Rocky Mountain Regional/Low-Permeability Reservoirs Symposium, Denver, Colo., 12-14 Apr. 1993. Define adjusted pseudopressure as:

$$p_a = \frac{\bar{\mu}_g \bar{z}}{\bar{p}} \int_0^p \frac{p\,dp}{\mu_g z}, \tag{52}$$

where z is the real gas deviation factor. It is a measure of the deviation of a real gas compared to an ideal gas. Then $$dp_w = \frac{\bar{p}}{\bar{\mu}_g \bar{z}} \left[\frac{\mu_g z}{p}\right]_{wb} dp_{aw}. \tag{53}$$

The "constant-rate" dimensionless pressure is defined by:

$$p_{awcD} = \frac{2\pi kh_p[(p_a)_i - (p_a)_{wb}]}{(q_g)_{sf} \bar{B}_g \bar{\mu}_g}, \tag{54}$$

and combining Eq. 54 with Eq. 53 results in:

$$dp_w = \frac{(q_g)_{sf} \bar{B}_g \bar{\mu}_g}{2\pi kh_p} \left[\frac{\bar{p}}{\bar{\mu}_g \bar{z}}\right] \left[\frac{\mu_g z}{p}\right]_{wb} dp_{awcD}, \tag{55}$$

where $h_p$ is the formation permeable thickness.

Define $$t_{aL_f D} = \frac{kt_a}{\phi \bar{\mu}_g \bar{c}_t L_f^2}, \tag{56}$$

and adjusted pseudotime as:

$$t_a = (\overline{\mu}_g \overline{c}_t) \int_0^t \frac{dt}{\mu_g c_t}, \text{ then} \tag{57}$$

$$\frac{1}{dt} = \frac{k}{\phi(\mu_g c_t)_{wb} L_f^2} \frac{1}{dt_{aL_fD}}. \tag{58}$$

With a slightly compressible injection fluid in a reservoir containing compressible fluids, piston-like displacement is assumed and the material balance equation is written as:

$$-1 = \frac{C}{q_{sf}} \frac{dp_w}{dt} = \frac{C}{(q_g)_{sf} \overline{B}_g} \frac{dp_w}{dt}. \tag{59}$$

When both the injected and reservoir fluids are compressible, writing the material balance equation in terms of dimensionless adjusted pseudovariables results in:

$$1 = \frac{C}{2\pi\phi(c_t)_{wb} h L_f^2} \frac{T_{wb}}{\overline{T}} \frac{dp_{awcD}}{dt_{aL_fD}}, \; p_{c,prop} < p_w(t), \tag{60}$$

where
$\phi$ is the porosity,
$c_t$ is the total compressibility,
h is the formation permeable thickness,
$L_f$ is created hydraulic fracture half-length,
T is reservoir temperature, and
$T_{wb}$ is wellbore temperature.

In order to make further approximations, we need to distinguish the before- and after-closure cases.

a) The before-closure limiting-case dimensionless wellbore-storage coefficient is not constant because of the total compressibility term; however, as closure stress increases, the total compressibility approaches a constant value and can be approximated by the total compressibility at closure, $(c_t)_{wb} \approx (c_t)_c$. When the net pressure generated during a fracture-injection/falloff test is minimal, that is, on the order of a few hundred psi or less, a better approximation is the average before closure total compressibility defined as:

$$(c_t)_{wb} \cong (\overline{c}_t)_{bc} = \frac{(c_t)_0 + (c_t)_c}{2}, \; p_{c,prop} < p_w(t). \tag{61}$$

With Eq. 61, the before-closure limiting-case dimensionless wellbore-storage coefficient is written as:

$$C_{bcL_fD} = \frac{C_{bc}}{2\pi\phi(\overline{c}_t)_{bc} h L_f^2} \frac{T_{wb}}{\overline{T}}, \; p_{c,prop} < p_w(t), \text{ and} \tag{62}$$

$$1 = C_{bcL_fD} \frac{dp_{awcD}}{dt_{aL_fD}}, \; p_{c,prop} < p_w(t), \tag{63}$$

where
$\phi$ is the porosity,
$c_t$ is the total compressibility,
$C_{bc}$ is the before-closure wellbore storage coefficient,
h is the formation permeable thickness,
$L_f$ is created hydraulic fracture half-length,
T is reservoir temperature, and
$T_{wb}$ is wellbore temperature.

b) The after-closure limiting-case dimensionless wellbore-storage coefficient is also derived from Eq. 60, but the after-closure wellbore total compressibility is approximated as:

$$(c_t)_{wb} \cong (\overline{c}_t)_{ac} = \frac{(c_t)_c + (c_t)_i}{2}, \; p_w(t) < p_c \;\; \& \;\; \overline{w}_{f0} > 0. \tag{64}$$

The after closure limiting-case dimensionless wellbore-storage coefficient is written as:

$$C_{acL_fD} = \frac{C_{ac}}{2\pi\phi(\overline{c}_t)_{ac} h L_f^2} \frac{T_{wb}}{\overline{T}}, \; p_w(t) < p_c \;\; \& \;\; \overline{w}_{f0} > 0, \text{ and} \tag{65}$$

$$1 = C_{acL_fD} \frac{dp_{awcD}}{dt_{aL_fD}}, \; p_w(t) < p_c \;\; \& \;\; \overline{w}_{f0} > 0, \tag{66}$$

where
$\phi$ is the porosity,
$(c_t)_{ac}$ is the after-closure total compressibility,
$C_{ac}$ is the after-closure wellbore storage coefficient,
h is the formation permeable thickness,
$L_f$ is created hydraulic fracture half-length,
T is reservoir temperature,
$T_{wb}$ is wellbore temperature, and
$\overline{w}_{f0} > 0$, is the existence of a residual fracture width.

Table 3 summarizes the before-closure and after-closure limiting case dimensionless wellbore storage coefficients for the four combinations of compressible or slightly-compressible injection and reservoir fluids.

TABLE 3

| | Dimensionless Wellbore Storage Coefficients | |
|---|---|---|
| Injected/Resevoir Fluid | Before-Closure Dimensionless Storage Coefficient | After-Closure Dimensionless Wellbore Storage Coefficient |
| Slightly Compressible/ Slightly Compressible | $C_{L_fD} = \frac{C_{bc}}{2\pi\phi c_t h L_f^2}$ | $C_{L_fD} = \frac{C_{ac}}{2\pi\phi c_t h L_f^2}$ |
| Compressible/ Slightly Compressible | $C_{L_fD} = \frac{C_{bc}}{2\pi\phi c_t h L_f^2}$ | $C_{L_fD} = \frac{C_{ac}}{2\pi\phi c_t h L_f^2}$ |

TABLE 3-continued

| Injected/Resevoir Fluid | Dimensionless Wellbore Storage Coefficients: Before-Closure Dimensionless Storage Coefficient | After-Closure Dimensionless Wellbore Storage Coefficient |
|---|---|---|
| Slightly Compressible/ Compressible | $C_{bcL_fD} = \frac{C_{bc}}{2\pi\phi(\bar{c}_t)_{bc}hL_f^2}\frac{T_{wb}}{T}$ | $C_{acL_fD} = \frac{C_{ac}}{2\pi\phi(\bar{c}_t)_{ac}hL_f^2}\frac{T_{wb}}{T}$ |
| Compressible/ Compressible | $C_{bcL_fD} = \frac{C_{bc}}{2\pi\phi(\bar{c}_t)_{bc}hL_f^2}\frac{T_{wb}}{T}$ | $C_{acL_fD} = \frac{C_{ac}}{2\pi\phi(\bar{c}_t)_{ac}hL_f^2}\frac{T_{wb}}{T}$ |

where $\phi$ is the porosity, $c_t$ is the total compressibility, h is the formation permeable thickness, $(c_t)_{bc}$ is average total compressibility before closure, $(c_t)_{ac}$ is average total compressibility after closure, $L_f$ is created hydraulic fracture half-length, T is reservoir temperature, $T_{wb}$ is wellbore temperature, $C_{bc}$ is the before-closure wellbore-storage coefficient, $C_{ac}$ is the after-closure wellbore-storage coefficient, and $C_{acc}$ is the after-closure wellbore-storage coefficient with compressible injected fluid.

VI) Diagnosing Wellbore and Fracture Storage

When the injection period of a refracturing-candidate diagnostic fracture-injection/falloff test is short relative to the reservoir response, the fracture-injection/falloff can be modeled as a slug test. Peres, A. M. M., Onur, M., and Reynolds, A. C.: in "A new General Pressure-Analysis Procedure for Slug Tests", SPEFE, December 1993, 292, have shown that the pressure data recorded during a slug test can be transformed into equivalent "constant-rate" pressure data by recognizing the slug-test solution is written as:

$$p_{D,slug} = C_D \frac{dp_{wcD}}{dt_D}, \tag{67}$$

for an unfractured-well slug test, and $$p_{D,slug} = C_{L_fD} \frac{dp_{wcD}}{dt_{L_fD}}, \tag{68}$$

for a fractured-well slug test as shown by Rushing, J. A. et al in "Analysis of Slug Test Data from Hydraulically Fractured Coalbed Methane Wells", paper SPE 21492 presented at the SPE Gas Technology Symposium, Houston, Texas, 23-25 Jan. 1991, where the dimensionless slug-test pressure for an injection is defined as:

$$p_{D,slug} = \frac{p_w(t) - p_i}{p_0 - p_i}, \tag{69}$$

and $p_{wcD}$ is the constant-rate dimensionless pressure.

Peres, A. M. M., Onur, M., and Reynolds, A. C.: in "A new General Pressure-Analysis Procedure for Slug Tests", SPEFE, December 1993, 292, have shown that Eq. 67 (or Eq. 68) can be integrated and written as:

$$P_{wcD} = \frac{1}{C_{L_fD}} \int_0^{t_{L_fD}} p_{D,slug}\, d\tau, \tag{70}$$

and the pressure derivative, $p'_{wcD}$, written as:

$$p'_{wcD} = \frac{dp_{wcD}}{d(\ln t_{L_fD})} = t_{L_fD}\frac{dp_{wcD}}{dt_{L_fD}} = \frac{t_{L_fD}}{C_{L_fD}} p_{D,slug}. \tag{71}$$

In terms of adjusted pseudovariables, the slug-test adjusted pseudopressure function for an injection is written as:

$$p_{aD,slug} = \frac{(p_a)_w - (p_a)_i}{(p_a)_o - (p_a)_i}, \tag{72}$$

and the "constant-rate" pressure transformation can now be written as:

$$\begin{aligned} p_{wcD} &= \frac{1}{C_{L_fD}} \int_0^{t_D} p_{D,slug}\, dt_D \\ &= \frac{1}{C_{aL_fD}} \int_0^{t_{aD}} p_{aD,slug}\, dt_{aD} \\ &= p_{awcD}, \end{aligned} \tag{73}$$

and the pressure derivative, $p'_{awcD}$, written as:

$$p'_{awcD} = \frac{dp_{awcD}}{d(\ln t_{aL_fD})} = t_{aL_fD}\frac{dp_{awcD}}{dt_{aL_fD}} = \frac{t_{aL_fD}}{C_{aL_fD}} p_{aD,slug}. \tag{74}$$

Consequently, the pressure data recorded during a refracture-candidate diagnostic fracture-injection/falloff test can be transformed to equivalent constant-rate pressure data.

A general form of the material balance equation during the limiting cases can be written as:

$$C_D dP_D = dt_D, \tag{75}$$

where $C_D=C_{L_fD}$, $C_{bcL_fD}$, or $C_{acL_fD}$; $p_D=p_{wD}$ or $p_{awD}$; and $t_D=t_{L_fD}$ or $t_{aL_fD}$.

With $C_D$ constant, Eq. 75 can be integrated, and taking the logarithm, results in:

$$\log(C_D)+\log(p_D)=\log(t_D). \tag{76}$$

Eq. 76 shows that during both the before- and after-closure limiting cases, a log-log graph of $p_D$ versus $t_D$, or a log-log graph of $p_D$ versus $t_D/C_D$, will result in a unit slope line during wellbore and fracture storage. Over the duration of wellbore storage distorted data, however, wellbore storage is variable with a before-closure wellbore-storage period transitioning to an after-closure wellbore-storage period.

Integrating Eq. 75 results in:

$$p_D = \frac{t_D}{C_D}, \tag{77}$$

and the well-testing pressure derivative is written as:

$$p'_D = \frac{d\,p_D}{d(\ln t_D)} = t_D\frac{d\,p_D}{d\,t_D} = \frac{t_D}{C_D}. \tag{78}$$

Eq. 78 shows that a log-log graph of $p'_D$ versus $t_D$ will also result in a unit slope line during the before- and after-closure wellbore storage limiting cases that overlays the log-log graph of $p_D$ versus $t_D$. Alternatively, a log-log graph of $p'_D$ versus $t_D/C_D$ with have a unit slope and overlay a log-log graph of $p_D$ versus $t_D/C_D$ during both before- and after-closure wellbore storage limiting cases.

FIG. 4 shows a graph of surface pressure and injection rate versus time for the fracture-injection/falloff test in an environment of water saturated coal reservoir. The test consisted of 1,968 gallons of 2% KCl treated water injected at an average rate of 2.70 bbl/min over a 17.5 minute injection period. The injection was followed by a 12 hour shut-in period to monitor the pressure falloff. As is shown in the graph, the pressure during most of the injection exceeded the fracture closure stress significantly. At the end of pumping, about 516 psi of pressure in excess of fracture closure stress had been created by the injection.

FIG. 5 depicts log-log graph of the transformed shut-in pressure data. The data are obtained in the environment as previously mentioned in FIG. 4. A wellbore storage unit-slope period corresponding to a constant wellbore storage coefficient during closure is clearly indicated during the before-closure pressure decline. After the data depart from the unit-slope line, a second unit-slope does not form. During the remainder of the test, the curves take the characteristic shape of a radial infinite-acting reservoir. The fracture-injection/falloff test confirms a fracture retaining residual width is not present in the formation.

The following Table 4 summarizes the well experimental conditions for water saturated coal reservoir prior to and during the injection test.

TABLE 4

Well experimental conditions

| Description | Value | Dimension |
|---|---|---|
| Depth | 5,350 | ft |
| Reservoir Fluid | Water | lb/gal |

TABLE 4-continued

Well experimental conditions

| Description | Value | Dimension |
|---|---|---|
| Density | 8.43 | |
| Injected Fluid | Water containing 2% KCl | lb/gal |
| Density | 8.43 | |
| h | 12 | ft |
| T | 130 | ° F. |
| Fracture Injection Falloff Test $(V_i)_{Total}$ | 1,968 | gal |
| $t_{ne}$ | 17.5 | min |

FIG. 2 shows a graph of surface pressure and injection rate versus time for the fracture-injection/falloff test in an environment of low permeability tight-gas sandstone with a pre-existing propped hydraulic fracture. The test consisted of 3,183 gallons of 1% KCl treated water injected at an average rate of 4.10 bbl/min over an 18.5 min injection period. The injection was followed by a 4-hour shut-in period to monitor the pressure falloff. As is also shown in the graph, the pressure during most of the injection exceeded the fracture closure stress significantly. At the end of the pumping, about 500 psi of pressure in excess of fracture closure stress had been created by the injection.

FIG. 3 depicts log-log plotting of transformed shut-in pressure data in terms of adjusted pseudovariables using the constant-rate data transformation. The data are obtained in the environment as previously mentioned in FIG. 2 where a propped hydraulic fracture treatment was pumped. The first unit slope period corresponds to a constant wellbore storage coefficient during closure. A second wellbore storage period with a constant coefficient appears to be developing at the end of the shut-in at pressures significantly less than fracture closure stress. The fracture-injection/falloff test as shown on FIG. 3 confirms that a fracture retaining residual width is present in the formation.

The following Table 4 summarizes the experimental conditions for low-permeability tight-gas sandstone prior to and during the injection test.

TABLE 4

Well experimental conditions

| Description | Value | Dimension |
|---|---|---|
| Depth | 5,722 | ft |
| Reservoir Fluid | Gas | |
| Specific Gravity (Air = 1.00) | 0.63 | |
| Injected Fluid | Water containing 1% KCl | lb/gal |
| Density | 8.37 | |
| h | 80 | ft |
| T | 175 | ° F. |
| Fracture Treatment Prior to Test Proppant Injected, $m_{prop}$ | 271,000 | lb |
| Fracture Injection Falloff Test $(V_i)_{Total}$ | 3,183 | gal |
| $t_{ne}$ | 18.5 | min |

Figure 6:
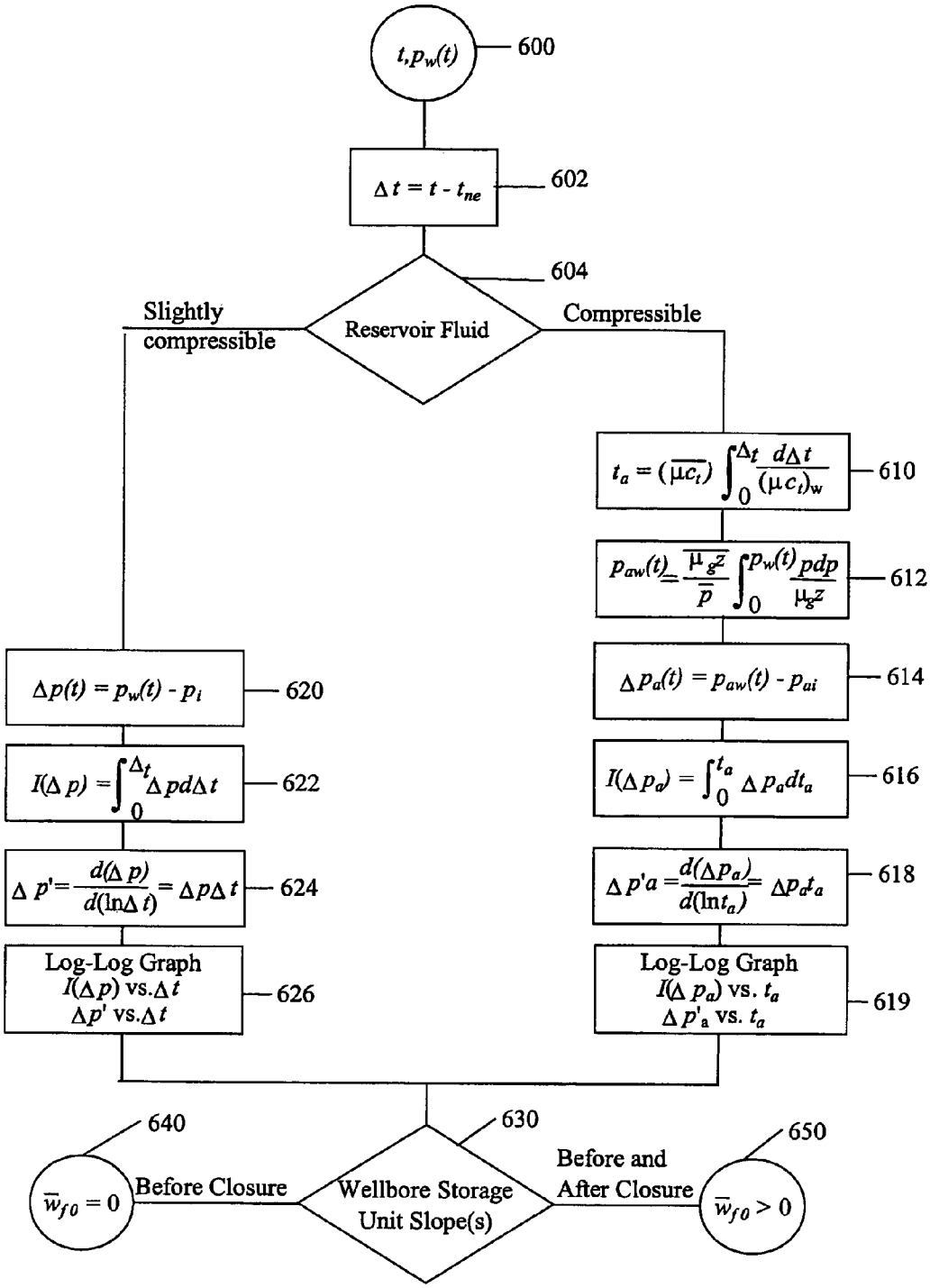
FIG. 6 is a general flow chart representing methods of detecting a fracture retaining residual width.

FIG. 6 illustrates a general flow chart representing methods of detecting a fracture retaining residual width. From the refracture-candidate diagnostic fracture-injection/falloff test data, the preferred procedure prepares a graph as follows.

The time at the end of pumping, $t_{ne}$, becomes the reference time zero, at step 600 $\Delta t=0$. Calculate the shut-in time relative to the end of pumping as $\Delta t=t-t_{ne}$ at step 602. A test is made at step 604 to determine whether the reservoir contains a compressible fluid or a slightly compressible fluid.

For a slightly-compressible fluid injection in a reservoir containing a compressible fluid, or a compressible fluid injection in a reservoir containing a compressible fluid, the compressible reservoir fluid properties are used in order to calculate, at step 610, the adjusted time as:

$$t_a = (\overline{\mu c_t}) \int_0^{\Delta t} \frac{d\Delta t}{(\mu c_t)_w}.$$

Based on the properties of the compressible reservoir fluid, calculate the adjusted pseudopressure difference as:

$$\Delta p_a(t) = p_{aw}(t) - p_{ai},$$

at steps 612 and 614 by using the adjusted pseudopressure defined as:

$$p_a = \frac{\overline{\mu}_g \overline{z}}{\overline{p}} \int_0^p \frac{p\,dp}{\mu_g z}.$$

Calculate the pressure-plotting function as:

$$I(\Delta p_a) = \int_0^a \Delta p_a dt_a$$

at step 616.

Calculate the pressure-derivative plotting function as:

$$\Delta p'_a = \frac{d(\Delta p_a)}{d(\ln t_a)} = \Delta p_a t_a$$

at step 618.

At step 619, prepare a log-log graph of $I(\Delta p_a)$ versus $t_a$ and a log-log graph of $\Delta p'_a$ versus $t_a$.

For a slightly-compressible fluid injection in a reservoir containing a slightly compressible fluid, or a compressible fluid injection in a reservoir containing a slightly compressible fluid, the pressure difference is calculated, at step 620, as:

$$\Delta p(t) = p_w(t) - p_i.$$

Calculate the pressure-plotting function as:

$$I(\Delta p) = \int_0^{\Delta t} \Delta p_d \Delta t,$$

at step 622.

Calculate the pressure-derivative plotting function as:

$$\Delta p' = \frac{d(\Delta p)}{d(\ln \Delta t)} = \Delta p \Delta t,$$

at step 624.

Prepare a log-log graph of $I(\Delta p)$ versus $\Delta t$ and a log-log graph of $\Delta p'$ versus $\Delta t$ at step 626.

At step 630, look for a unit slope before-fracture closure and a unit slope after-fracture closure with the pressure derivative overlaying the pressure curve or adjusted pressure derivative overlaying the adjusted pressure curve.

Dual unit-slope periods before- and after-fracture closure suggest a fracture retaining residual width exists, at step 650.

Conversely, a single unit-slope period before-fracture closure suggests a fracture retaining residual width does not exist, at step 640.

Figure 7:
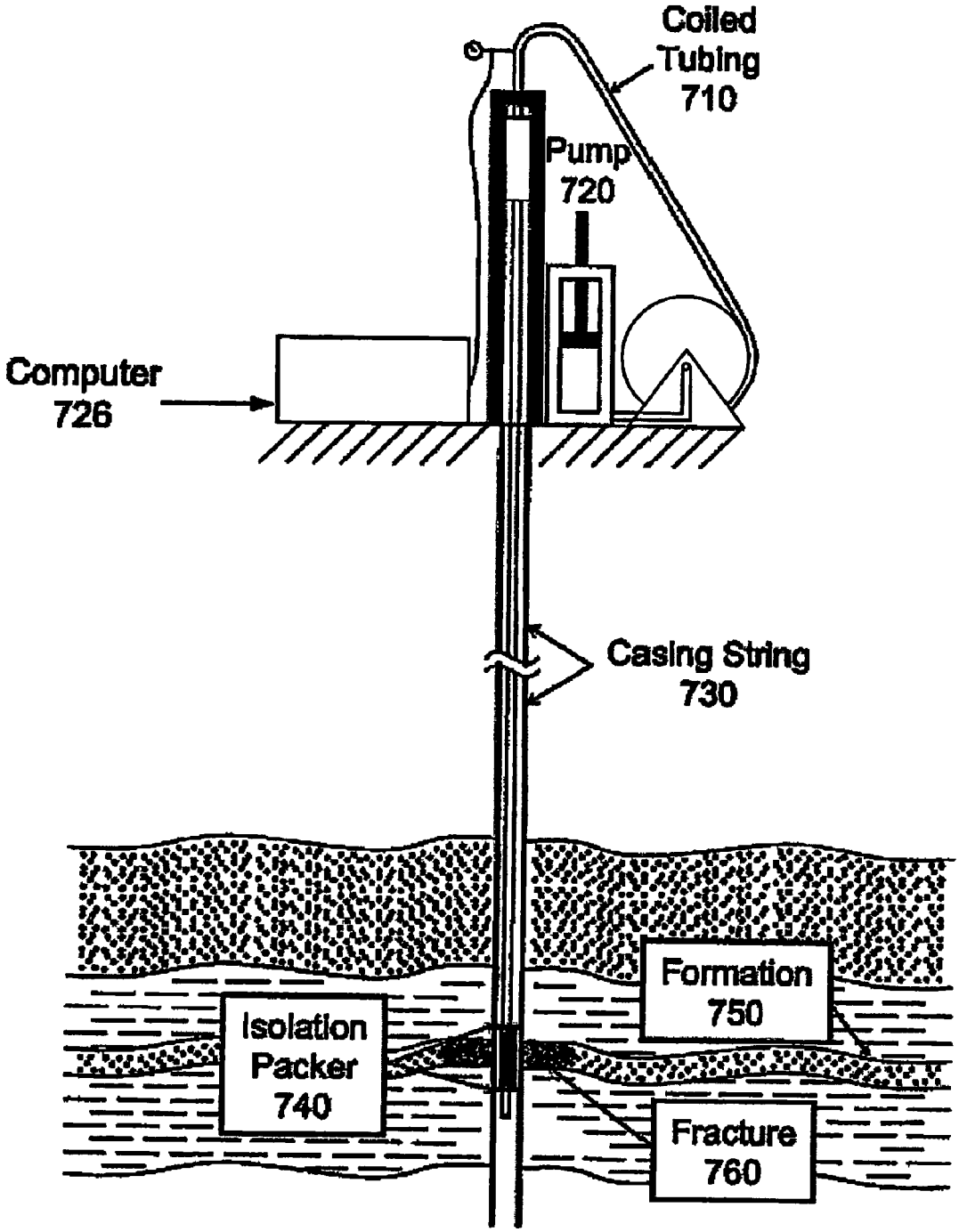
FIG. 7 shows schematically an apparatus located in a wellbore useful in performing the methods of the present invention.

FIG. 7 illustrates schematically an example of an apparatus located in a drilled wellbore to perform the methods of the present invention. Coiled tubing 710 is suspended within a casing string 730 with a plurality of isolation packers 740 arranged spaced apart around the coiled tubing so that the isolation packers can isolate a target formation 750 and provide a seal between the coiled tubing 710 and the casing string 730. These isolation packers can be moved downward or upward in order to test the different layers within the wellbore.

A suitable hydraulic pump 720 is attached to the coiled tubing in order to inject the injection fluid in a reservoir to test for an existing fracture 760. Instrumentation for measuring pressure of the reservoir and injected fluids (not shown) or transducers are provided. The pump which can be a positive displacement pump is used to inject small volumes of compressible or slightly compressible fluids containing desirable additives for compatibility with the formation at an injection pressure exceeding the formation fracture pressure.

The data obtained by the measuring instruments are conveniently stored for later manipulation and transformation within a computer 726 located on the surface. Those skilled in the art will appreciate that the data are transmitted to the surface by any conventional telemetry system for storage, manipulation and transformation in the computer 726. The transformed data representative of the before and after closure periods of wellbore storage are then plotted and viewed on a printer or a screen to detect a single or a dual unit slope. The detection of a dual unit slope is indicative of the existence of a remaining residual width within the fracture.

The invention, therefore, is well adapted to carry out the objects and to attain the ends and advantages mentioned, as well as others inherent therein. While the invention has been depicted, described and is defined by reference to exemplary embodiments of the invention, such references do not imply a limitation on the invention, and no such limitation is to be inferred. The invention is capable of considerable modification, alternation and equivalents in form and function, as will occur to those ordinarily skilled in the pertinent arts and having the benefit of this disclosure. The depicted and described embodiments of the invention are exemplary only, and are not exhaustive of the scope of the invention. Consequently, the invention is intended to be limited only by the spirit and scope of the appended claims, giving full cognizance to equivalents in all respects.

What is claimed is:

1. A method of detecting a fracture with residual width from a previous well treatment during a well fracturing operation in a subterranean formation containing a reservoir fluid, comprising the steps of:

(a) injecting an injection fluid into the formation at an injection pressure exceeding the formation fracture pressure;

(b) gathering pressure measurement data from the formation during the injection and a subsequent shut-in period;

(c) transforming the pressure measurement data into a constant rate equivalent pressure; and (d) detecting the presence of a dual unit-slope wellbore storage in the transformed pressure measurement data, said dual unit-slope being indicative of the presence of a fracture retaining residual width;

wherein the reservoir fluid is compressible;

the transformation of pressure measurement data is based on the properties of the compressible fluid contained in the reservoir; and the transforming step comprises the step of calculating:

a shut-in time relative to the end of the injection: $\Delta t = t - t_{ne}$;

an adjusted time:

$$t_a = (\overline{\mu c_t}) \int_0^{\Delta t} \frac{d\Delta t}{(\mu c_t)_w};$$

and an adjusted pseudo pressure difference:

$$\Delta p_a(t) = p_{aw}(t) - p_{ai} \text{ where } p_a = \frac{\overline{\mu}_g \overline{z}}{\overline{p}} \int_0^p \frac{p\,dp}{\mu_g z};$$

wherein:

$t_{ne}$ is the time at the end of injection;

$\overline{\mu}$ is the viscosity of the reservoir fluid at average reservoir pressure;

$(\mu c_t)_w$ is the viscosity compressibility product of wellbore fluid at time t;

$(\mu c_t)_0$ is the viscosity compressibility product of wellbore fluid at time $t = t_{ne}$;

p is the pressure;

$\overline{p}$ is the average reservoir pressure;

$p_{aw}(t)$ is the adjusted pressure at time t;

$p_{ai}$, is the adjusted pressure at time $t = t_{ne}$;

$c_t$ is the total compressibility;

$\overline{c}_t$ is the total compressibility at average reservoir pressure; and z is the real gas deviator factor.

2. The method of claim 1 wherein the time of injection is limited to the time required for the reservoir fluid to exhibit pseudoradial flow.

3. The method of claim 1 further comprising the step of plotting a log-log graph of a pressure function versus time: $I(\Delta p_a) = F(t_a)$;

where $$I(\Delta p_a) = \int_0^a \Delta p_a\, dt_a.$$

4. The method of claim 1 further comprising the step of plotting a log-log graph of a pressure derivative function versus time: $\Delta p_a = f(t_a)$;

where $$\Delta p_a' = \frac{d(\Delta p_a)}{d(\ln t_a)} = \Delta p_a t_a.$$

5. The method of claim 1 wherein the injection fluid is slightly compressible and contains desirable additives for compatibility with said formation.

6. The method of claim 1 wherein the injection fluid is compressible and contains desirable additives for compatibility with said formation.

7. The method of claim 1 wherein the reservoir fluid is slightly compressible; and the transformation of pressure measurement data is based on the properties of the slightly compressible fluid contained in the reservoir.

8. The method of claim 7 wherein the transforming step comprises the step of calculating:

a pressure difference: $\Delta p(t) = p_w(t) - p_i$;

wherein:

$p_w(t)$ is the pressure at time t; and $p_i$ is the initial pressure at time $t = t_{ne}$.

9. The method of claim 8 further comprising the step of plotting a log-log graph of a pressure function, $I(\Delta p)$, versus time, $\Delta t$ where $$I(\Delta P) = \int_0^{\Delta t} (\Delta p)(d\Delta t).$$

10. The method of claim 8 further comprising the step of plotting a log-log graph of a pressure derivatives function versus time: $\Delta p' = f(\Delta t)$;

where $$\Delta p' = \frac{d(\Delta p)}{d(\ln \Delta t)} = \Delta p \Delta t.$$

11. The method of claim 7 wherein the injection fluid is compressible and contains desirable additives for compatibility with said formation.

12. The method of claim 7 wherein the injection fluid is slightly compressible and contains desirable additives for compatibility with said formation.

13. A system for detecting a fracture with residual width from a previous well treatment during a well fracturing operation in a subterranean formation containing a reservoir fluid, comprising:

a pump for injecting an injection fluid at an injection pressure exceeding the formation fracture pressure;

means for gathering pressure measurement data in the wellbore at various points in time during the injection and a subsequent shut-in period;

processing means for transforming said pressure measurement data into a constant rate equivalent pressure; and means for detecting the presence of a dual unit-slope wellbore storage in the transformed pressure measurement data, said dual unit-slope being indicative of the presence of a fracture retaining residual width;

wherein the reservoir fluid is compressible;

the transformation of pressure measurement data is based on the properties of the compressible reservoir fluid; and the transformed data are obtained by calculating:

a shut-in time relative to the end of the injection: $\Delta t = t - t_{ne}$;

an adjusted time:

$$t_a = (\overline{\mu c_t}) \int_0^{\Delta t} \frac{d\Delta t}{(\mu c_t)_w};$$

and an adjusted pseudo pressure difference:

$$\Delta p_a(t) = p_{aw}(t) - p_{ai} \quad \text{where} \quad p_a = \frac{\bar{\mu}_g \bar{z}}{\bar{p}} \int_0^p \frac{p\,dp}{\mu_g z};$$

wherein:

$t_{ne}$ is the time at the end of injection;

$\bar{\mu}$ is the viscosity of the reservoir fluid at average reservoir pressure;

$(\mu c_t)_w$ viscosity compressibility product of wellbore fluid at time t;

$(\mu c_t)_0$ is the viscosity compressibility product of wellbore fluid at time $t=t_{ne}$;

p is the pressure;

$\bar{p}$ is the average reservoir pressure;

$p_{aw}(t)$ is the pressure at time t;

$p_{at}$ is the pressure at time $t=t_{ne}$;

$c_t$ is the total compressibility;

$\bar{c}_t$ is the total compressibility at average reservoir pressure; and z is the real gas deviator factor.

14. The system of claim 13 wherein the processing means comprises graphics means for plotting said transformed pressure measurement data.

15. The system of claim 13 wherein the time of injection of said injecting means is limited to the time required for the reservoir fluid to exhibit pseudoradial flow.

16. The system of claim 13 further comprising graphic means for plotting a log-log graph of a pressure function versus time: $I(\Delta p_a)=f(t_a)$;

where $$I(\Delta p_a) = \int_0^{t_a} \Delta p_a\,dt_a.$$

17. The system of claim 13 further comprising graphic means for plotting a log-log graph of a pressure derivative function versus time: $\Delta p'_a=f(t_a)$;

where $$\Delta p'_a = \frac{d(\Delta p_a)}{d(\ln t_a)} = \Delta p_a t_a.$$

18. The system of claim 13 wherein the injection fluid is compressible and contains desirable additives for compatibility with said formation.

19. The system of claim 13 wherein the injection fluid is slightly compressible and contains desirable additives for compatibility with said formation.

20. The system of claim 13 wherein:

the reservoir fluid is slightly compressible; and the transformation of pressure measurement data is based on the properties of the slightly compressible reservoir fluid.

21. The system of claim 20 wherein the transformed data are obtained by further calculating:

a pressure difference: $\Delta p(t)=p_w(t)-p_t$;

wherein:

$p_w(t)$ is the pressure at time t; and $p_t$ is the initial pressure at time $t=t_{ne}$.

22. The system of claim 21 further comprising graphic means for plotting a log-log graph of a pressure function, $I(\Delta p)$, versus time, $\Delta t$ where $$I(\Delta P) = \int_0^{\Delta t} (\Delta p)(d\Delta t).$$

23. The system of claim 21 further comprising graphic means for plotting a log-log graph of a pressure derivatives function versus time: $\Delta p'=f(\Delta t)$;

where $$\Delta p' = \frac{d(\Delta p)}{d(\ln \Delta t)} = \Delta p \Delta t.$$

24. A system for detecting a fracture with residual width from previous well treatment during a well fracturing operation in a subterranean formation containing a reservoir fluid, comprising:

a pump for injecting an injection fluid at an injection pressure exceeding the formation fracture pressure;

means for gathering pressure measurement data in the wellbore at various points in time during the injection and a subsequent shut-in period;

processing means for transforming said pressure measurement data into a constant rate equivalent pressure; and graphics means for plotting said transformed pressure measurement data representative of before and after closure periods of wellbore storage, and for detecting a dual unit-slope wellbore storage indicative of the presence of a fracture retaining residual width;

wherein the reservoir fluid is compressible;

the transformation of pressure measurement data is based on the properties of the compressible reservoir fluid; and the transformed data are obtained by calculating:

a shut-in time relative to the end of the injection: $\Delta t=t-t_{ne}$;

an adjusted time:

$$t_a = (\overline{\mu c_t}) \int_0^{\Delta t} \frac{d\Delta t}{(\mu c_t)_w};$$

and an adjusted pseudo pressure difference: $\Delta p_a(t)=p_{aw}(t)-p_{at}$ where $$p_a = \frac{\bar{\mu}_g \bar{z}}{\bar{p}} \int_0^p \frac{p\,dp}{\mu_g z};$$

wherein:

$t_{ne}$ is the time at the end of injection;

$\bar{\mu}$ is the viscosity of the reservoir fluid at average reservoir pressure;

$(\mu c_t)_w$ is the viscosity compressibility product of wellbore fluid at time t;

$(\mu c_t)_0$ is the viscosity compressibility product of wellbore fluid at time $t=t_{ne}$;

p is the pressure;

$\bar{p}$ is the average reservoir pressure;

$p_{aw}(t)$ is the pressure at time t;

$p_{at}$ is the pressure at time $t=t_{ne}$;

$c_t$ is the total compressibility;

$\bar{c}_t$ is the total compressibility at average reservoir pressure; and z is the real gas deviator factor.

25. The system of claim 24 wherein the injection fluid is compressible or slightly compressible and contains desirable additives for compatibility with said formation.

26. The system of claim 24 wherein:

the reservoir fluid is slightly compressible;

the injection fluid is compressible or slightly compressible and contains desirable additives for compatibility with said formation; and the transformation of pressure measurement data is based on the properties of the slightly compressible reservoir fluid.

* * * * *